US006053710A

United States Patent [19]

Chung

[11] Patent Number: 6,053,710

[45] Date of Patent: Apr. 25, 2000

[54] CEILING FAN AND FAN BLADE FOR A FAN

[76] Inventor: Liu Chih Chung, No. 16, Sec. 1, Shen Yuan Road, Taichung, Taiwan

[21] Appl. No.: 09/208,244

[22] Filed: Dec. 9, 1998

[51] Int. Cl.[7] ..... F04D 29/38; F04B 17/03

[52] U.S. Cl. ..... 417/423.15; 416/5; 416/228; 416/237; 416/244 R

[58] Field of Search ..... 417/360, 423.15; 416/5, 228, 235, 237, 244 R

[56] References Cited

U.S. PATENT DOCUMENTS 4,693,673 9/1987 Nee ..... 416/5 X
5,803,721 9/1998 Lee ..... 417/423.15 X

FOREIGN PATENT DOCUMENTS 100039 5/1925 Austria ..... 416/237

*Primary Examiner*—Tony M. Argenbright
*Attorney, Agent, or Firm*—Donald C. Casey, Esq.

[57] ABSTRACT

A fan blade having a flow bumper curved backwards at a front side thereof, a mouth on the middle for gathering currents of air, a flow guide obliquely forwardly extending from the flow bumper at a top side above the mouth, and a rack and a mounting board vertically disposed at a rear side thereof for connection to a hub of a fan motor. The invention also provides a ceiling fan which has air guide means for guiding outside fresh air in for circulation upon operation of the ceiling fan.

3 Claims, 7 Drawing Sheets

CEILING FAN AND FAN BLADE FOR A FAN

BACKGROUND OF THE INVENTION

The present invention relates to electric fans, and more particularly to a ceiling fan with improved structures of fan blades.

A regular fan blade for a fan, as shown in FIG. 1, is generally comprised of a mounting rack, and an elongated blade body smoothly curved from the mounting rack and tilted in one direction. When the fan blade is turned with the hub of the fan motor, a downward wind pressure is produced to expel a flow of air outwards. This structure of fan blade is less efficient in causing currents of air, and not durable in use. A fan equipped with this structure of fan blade consumes much energy during its operation. Further, conventional ceiling fans are designed to cause currents of air only. They cannot cause fresh air to circulate.

SUMMARY OF THE INVENTION

The present invention has been accomplished under the circumstances in view. It is one object of the present invention to provide a fan blade for a fan which is efficient in causing currents of air. It is another object of the present invention to provide a fan blade for a fan which is durable in use. It is still another object of the present invention to provide a fan blade for a fan which saves power consumption. It is still another object of the present invention to provide a ceiling fan which causes fresh air to circulate when operated. A fan blade according to the present invention comprises a flow bumper curved backwards at a front side thereof, a mouth on the middle for gathering currents of air, a flow guide obliquely forwardly extending from the flow bumper at a top side above the mouth, and a rack and a mounting board vertically disposed at a rear side thereof for connection to a hub of a fan motor. A ceiling fan according to the present invention comprises a mounting rack, a fan motor suspended from the mounting rack, the fan motor comprising a stator having a hollow center shaft, a rotor around the stator, and a top cover shell and a bottom cover shell fixedly fastened to the rotor at top and bottom sides, a hub with fan blades fixedly fastened to the bottom cover shell of the fan motor and rotated with the rotor, a guard board suspended below the fan blades of the hub, a guide tube connected to the hollow center shaft of the stator of the fan motor and extended out of the mounting rack for guiding outside fresh air in.

DETAILED DESCRIPTION OF THE PREFERRED EMBODIMENT

Figure 1:
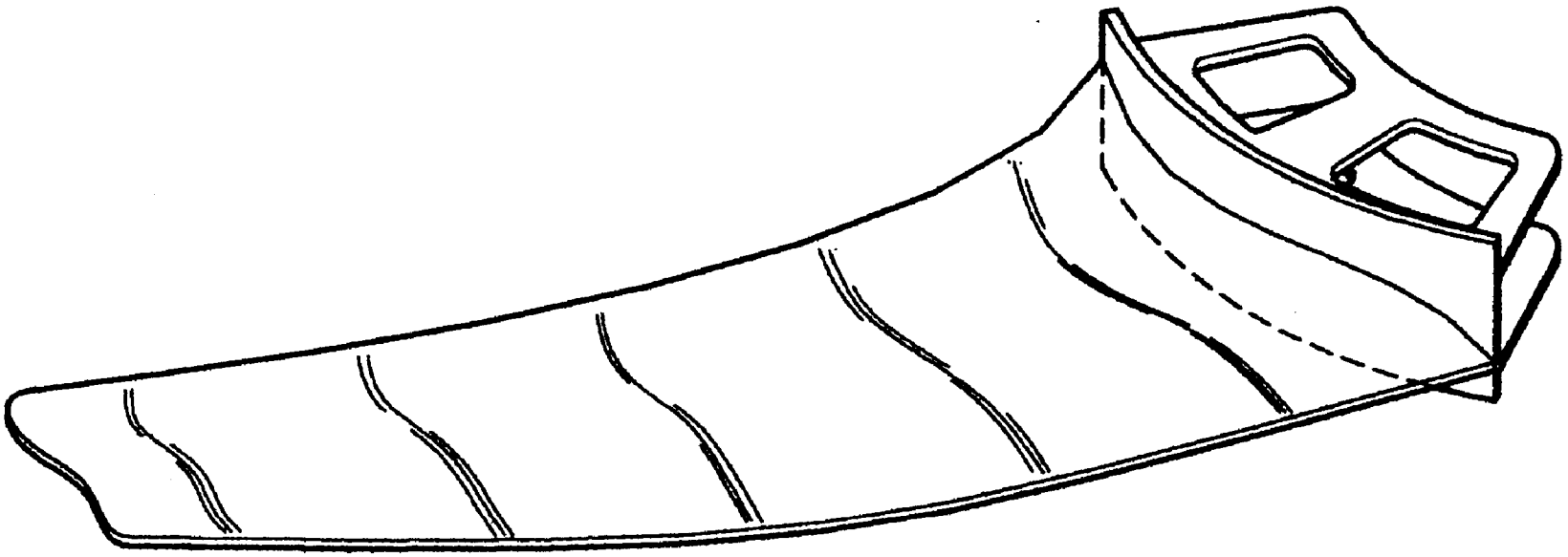
FIG. 1 is a perspective view of a fan blade for a fan according to the prior art.
Figure 2:
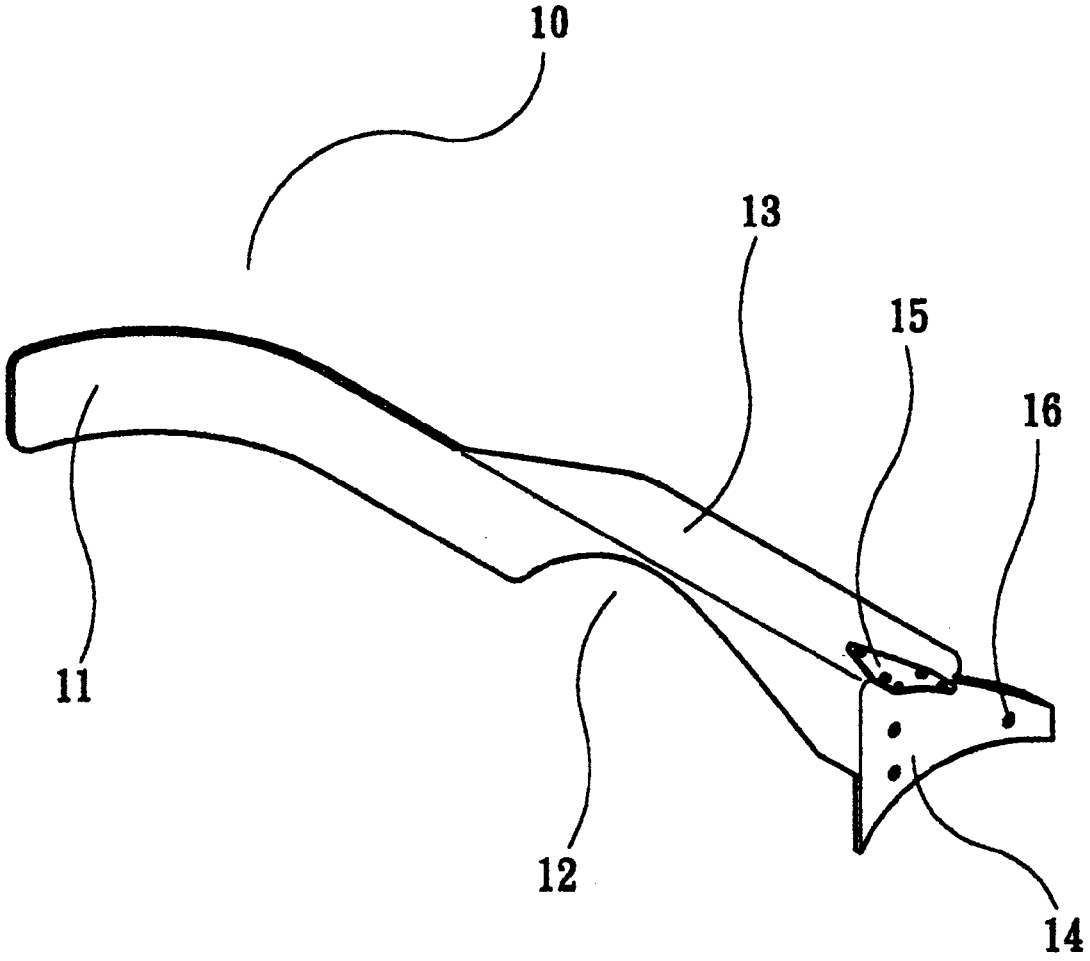
FIG. 2 is a perspective view of a fan blade for a fan according to the present invention.
Figure 3A:
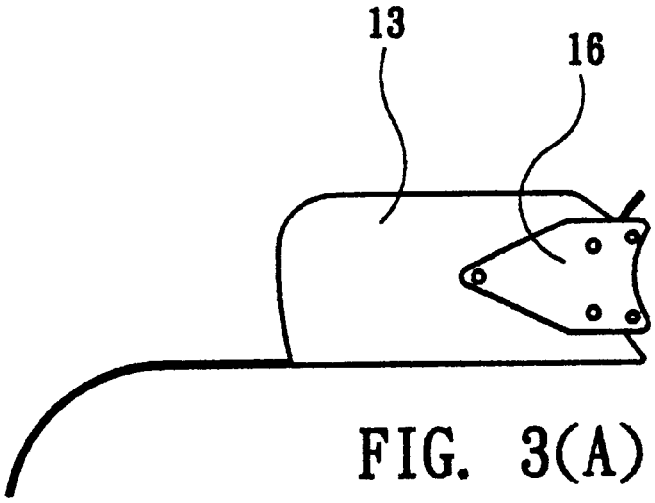
FIG. 3A is a top view of the fan blade shown in FIG. 2.
Figure 3B:
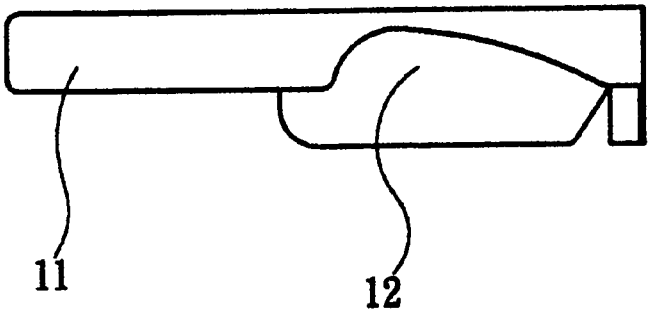
FIG. 3B is a front view of the fan blade shown in FIG. 2.
Figure 3C:
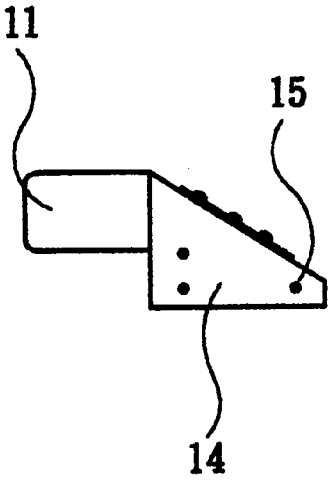
FIG. 3C is right side view of the fan blade shown in FIG. 2.

Referring to FIG. 2, a fan blade 10 is shown comprising a flow bumper 11, a mouth 12 for gathering currents of air, a flow guide 13, and a rack 14. The flow bumper 11 curves backwards to stop currents of air, enabling currents of air to be guided in the mouth 12. The mouth 12 is formed at the flow bumper 11 near the rack 14. The flow guide 13 obliquely forwardly extends from the flow bumper 11 above the mouth 12. The rack 14 and the mounting board 16 are connected together and perpendicularly extended from the rear end of the flow guide 13 adjacent to the mouth 12. A plurality of mounting holes 15 are provided at the rack 14 and the mounting board 16. FIGS. 3A, 3B and 3C are top, front and right side views of the fan blade 10. As illustrated in FIG. 3A, the flow bumper 11 curves in direction towards the rack 14, and terminates in a flat face. The mouth 12 is formed at the flow bumper 11 near its root (see FIG. 3B). The vertical width of the mouth 12 gradually reduces toward the rack 14 (see FIG. 3B). The flow guide 13 slopes downwards from the top side of the flow bumper 11 above the mouth 12. The transverse width of the flow guide 13 is greater than the transverse width of the mouth 12.

Figure 4:
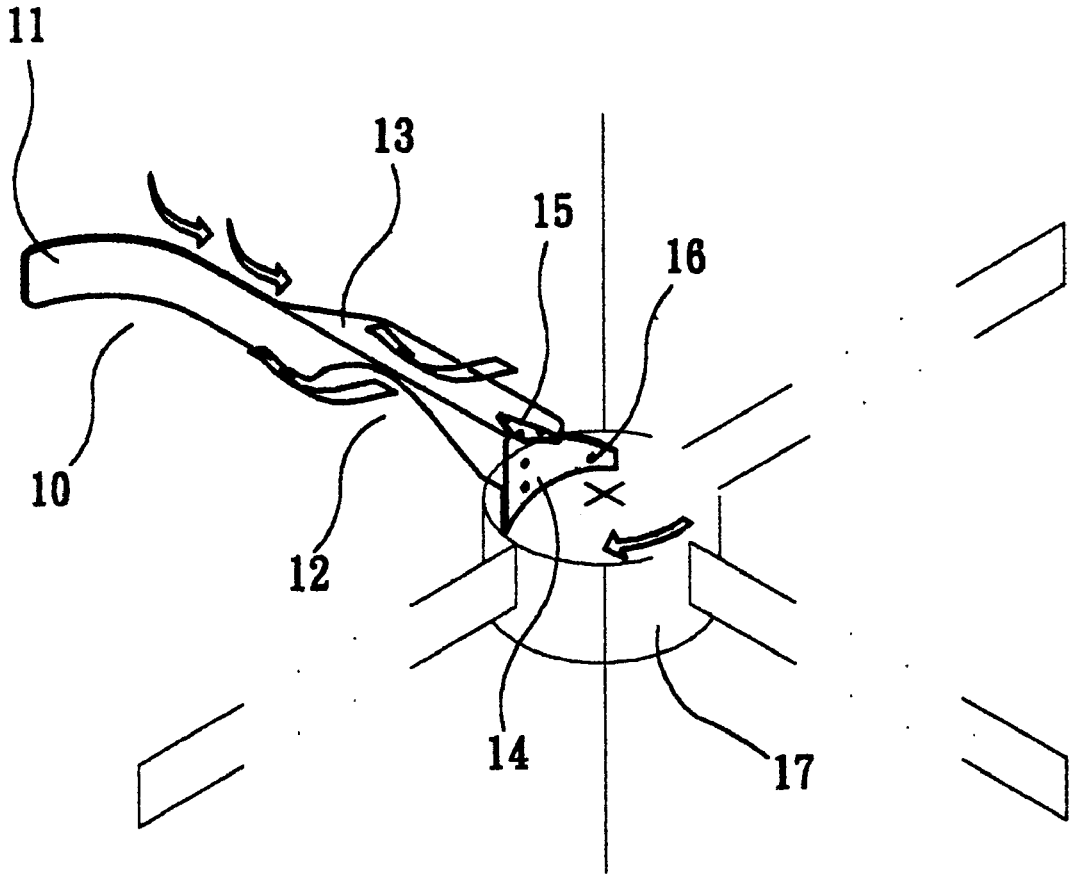
FIG. 4 illustrates fan blades installed in a hub according to the present invention.

Referring to FIG. 4, the mounting holes 15 at the rack 14 and the mounting board 16 are respectively fastened to the hub 17 (of a fan motor). When the hub 17 is rotated, currents of air are stopped by the flow bumper 11, and guided by it into the mouth 12, and then guided radially upwardly outwards by the flow guide 13.

Figure 5:
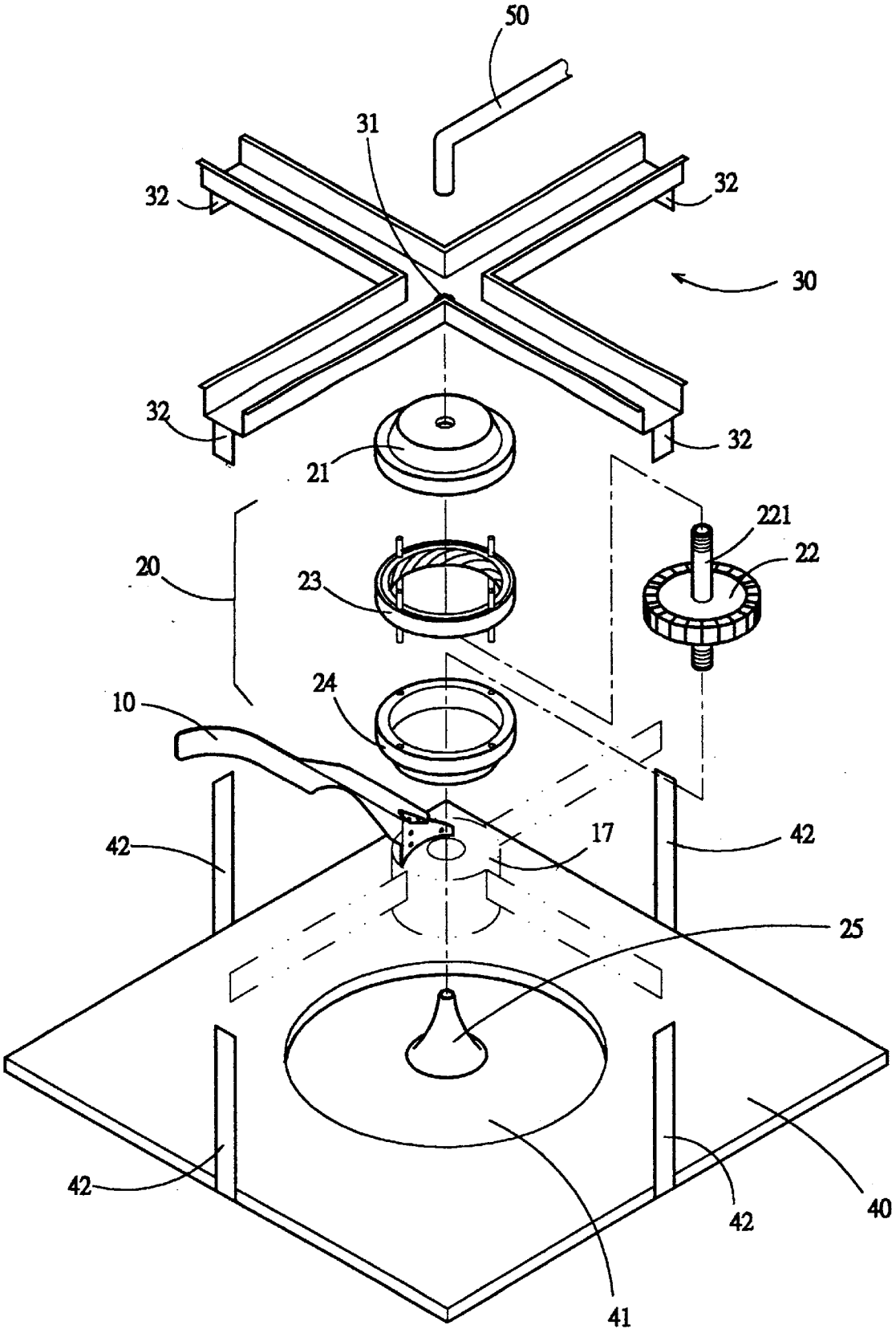
FIG. 5 is an exploded view of a ceiling fan according to the present invention.

Referring to FIG. 5, a ceiling fan is shown comprised of a crossed mounting rack 30. The mounting rack 30 has a center hole 31, and a plurality of connecting strips 32 respectively downwardly extended from the ends thereof. A fan motor 20 is suspended from the mounting rack 30. The fan motor 20 is comprised of a stator 22 at the center, a rotor 23 around the stator 22, a top cover shell 21, and a bottom cover shell 24. The top cover shell 21 and the bottom cover shell 24 are fastened to top and bottom sides of the rotor 23. The stator 22 is mounted with windings, having a hollow center shaft 221 extended out of the top cover shell 21 and the bottom cover shell 24. The top end of the hollow center shaft 221 of the stator 22 is fastened to the center hole 31 at the crossed mounting rack 30. A hub 17 to which a plurality of fan blades 10 are radially connected is connected to the bottom cover shell 24. When the rotor 23 are rotated, the hub 17 is rotated with the bottom cover shell 24. A guide tube 50 is connected to the top end of the hollow center shaft 221 of the stator 22, and extended to the outside of the house (in which the ceiling fan is installed). A guard board 40 is suspended below the fan blades 10. The guard board 40 has a center suction hole 41 through which the fan blades 42 draw outside air in, and a plurality of connecting strips 42 respectively upwardly extended from peripheral sides thereof and connected to the connecting strips 32 at the crossed mounting rack 30.

Figure 6:
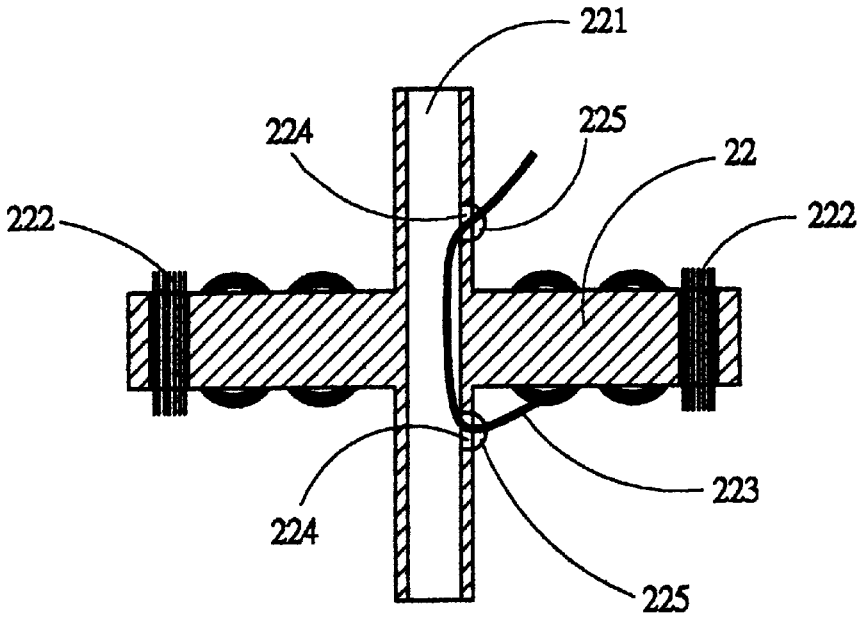
FIG. 6 is a sectional view in an enlarged scale of the stator shown in FIG. 5.

Referring to FIG. 6, windings 222 are mounted on the stator 22. An electric wire 223 is inserted through top and bottom through holes 224 at the hollow center shaft 221 of the stator 22, and connected to the windings 222 to guide electricity to the windings 222. After installation of the lead wire 223, the through holes 224 are sealed with sealing means 225.

Figure 7:
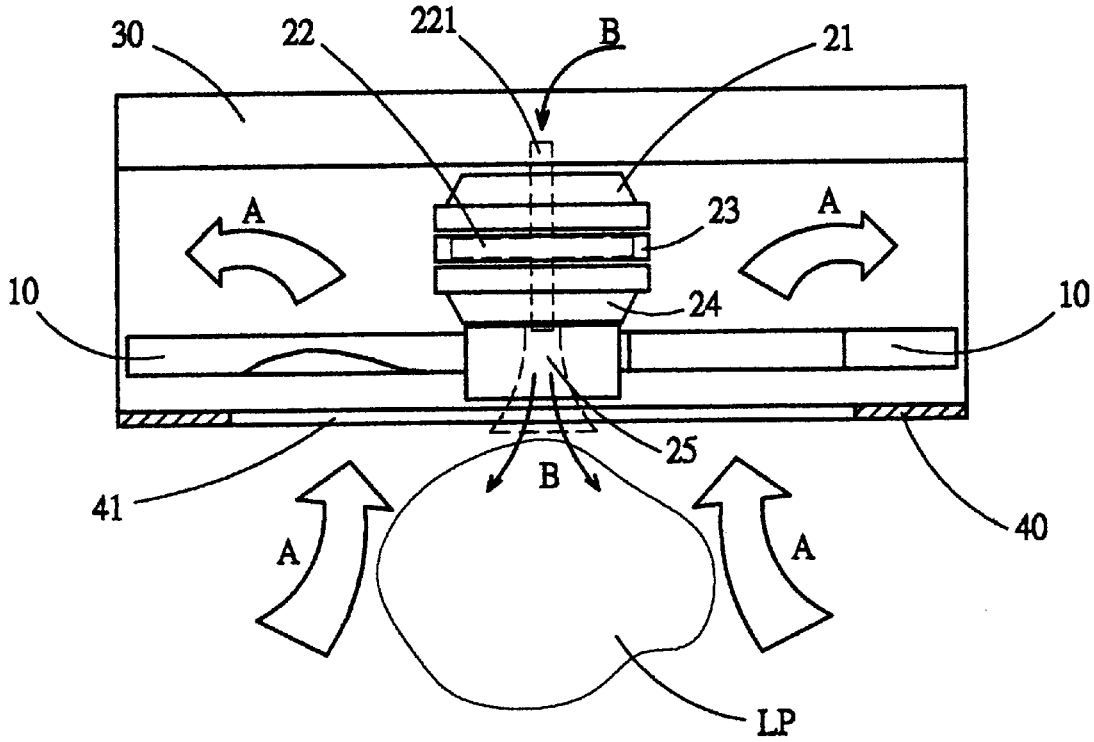
FIG. 7 is a schematic drawing showing the ceiling fan operated according to the present invention.

Referring to FIG. 7 and FIG. 5 again, when the fan blades 10 are turned with the hub 17, currents of air are sucked in through the center suction hole 41 and then expel out of the space defined between the guard board 40 and the ceiling in different directions. The reference sign A indicates the flowing direction of currents of air. During rotary motion of the fan blades 10, an upward wind force is produced, causing a low pressure area LP to be formed below the guard board 40, which sucks in ambient air. A fitting 25 is mounted in the bottom cover shell 24 and connected to the bottom end of the hollow center shaft 221 of the stator 22. When a low pressure area LP is formed below the guard board 40, outside fresh air is sucked in through the guide tube 50 and the fitting 25 in direction B.

Figure 8:
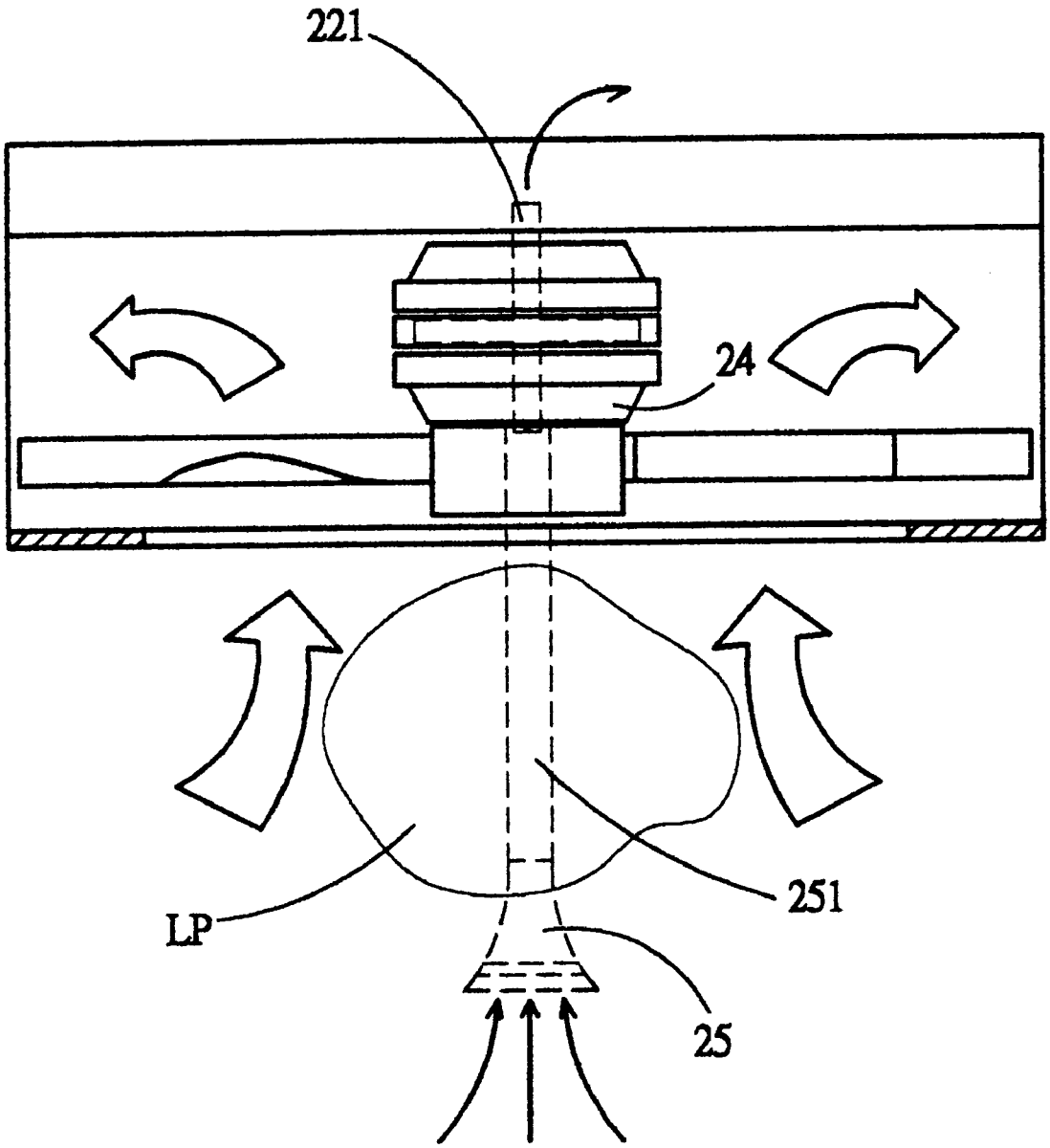
FIG. 8 shows an alternate form of the ceiling fan according to the present invention.

Referring to FIG. 8, an extension tube 251 may be coupled between the bottom end of the hollow center shaft 221 of the stator 22 and the fitting 25 and rotated with the bottom cover shell 24 (the rotor 23), enabling the fitting 25, which has induced-draft fan blades on the inside, to be suspended below the low pressure area LP. When the stator 22 is rotated, the induced-draft fan blades draw indoor air to the outside through the extension tube 251 and the hollow center shaft 221.

What the invention claimed is:

1. A fan blade comprising a flow bumper curved backwards at a front side thereof, a mouth on the middle for gathering currents of air, a flow guide obliquely forwardly extending from said flow bumper at a top side above said mouth, and a rack and a mounting board vertically disposed at a rear side thereof for connection to a hub of a fan motor.

2. A ceiling fan comprising:

a mounting rack, said mounting rack having a center hole, and a plurality of connecting strips respectively downwardly extended from ends thereof;

a fan motor suspended from said mounting rack, said fan motor comprising a stator at the center, said stator being mounted with a plurality of windings and having a hollow center shaft fixedly fastened to the center hole of said mounting rack, a rotor around said stator, a top cover shell and a bottom cover shell mounted around the center shaft of said stator and fixedly fastened to said rotor at top and bottom sides;

a hub fixedly fastened to the bottom cover shell of said fan motor, said hub holding a plurality of fan blades around the periphery thereof, said fan blades each comprising a flow bumper curved backwards at a front side, a mouth on the middle for gathering currents of air, a flow guide obliquely forwardly extending from said flow bumper at a top side above said mouth, and a rack and a mounting board vertically disposed at a rear side and respectively connected to said hub;

a guard board suspended below said fan blades, said guard board having a center suction hole through which said fan blades draw outside air in, and a plurality of connecting strips respectively upwardly extended from peripheral sides thereof and connected to the connecting strips at said mounting rack;

a guide tube having one end connected to said hollow center shaft of said stator and an opposite end extended out of said mounting rack; and a fitting connected to the bottom cover shell of said fan motor for guiding in air to said guide tube through the hollow center shaft of said stator.

3. The ceiling fan of claim 2 further comprising an extension tube having a top end fixedly connected to the bottom cover shell of said fan motor and in communication with the hollow center shaft of said stator and a bottom end connected to said fitting to hold said fitting below said guard board at a distance.

* * * * *